US008872726B2

(12) United States Patent
Kusanagi

(10) Patent No.: US 8,872,726 B2
(45) Date of Patent: Oct. 28, 2014

(54) ANTENNA DEVICE

(75) Inventor: Kanenari Kusanagi, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 225 days.

(21) Appl. No.: 13/382,622

(22) PCT Filed: May 7, 2010

(86) PCT No.: PCT/JP2010/057785
§ 371 (c)(1),
(2), (4) Date: Jan. 6, 2012

(87) PCT Pub. No.: WO2011/004649
PCT Pub. Date: Jan. 13, 2011

(65) Prior Publication Data

US 2012/0105303 A1 May 3, 2012

(30) Foreign Application Priority Data

Jul. 10, 2009 (JP) ..... 2009-163889

(51) Int. Cl.
*H01Q 1/50* (2006.01)

(52) U.S. Cl.
USPC ..... 343/909

(58) Field of Classification Search
USPC ..... 343/905, 767, 700 MS, 702
See application file for complete search history.

(56) References Cited

U.S. PATENT DOCUMENTS

| | | | | |
|---|---|---|---|---|
| 7,777,682 | B2 * | 8/2010 | Yagi | 343/725 |
| 8,081,124 | B2 * | 12/2011 | Yagi | 343/702 |
| 8,400,364 | B2 * | 3/2013 | Kotaka et al. | 343/702 |
| 2005/0035919 | A1 * | 2/2005 | Yang et al. | 343/795 |
| 2006/0001590 | A1 * | 1/2006 | Hung et al. | 343/846 |
| 2008/0180342 | A1 * | 7/2008 | Kerselaers | 343/795 |
| 2010/0302111 | A1 * | 12/2010 | Kotaka et al. | 343/702 |

FOREIGN PATENT DOCUMENTS

| | | |
|---|---|---|
| JP | 04-056157 | 2/1992 |
| JP | 2004-173143 | 6/2004 |
| JP | 2005-136784 | 5/2005 |
| JP | 2005-142739 | 6/2005 |
| JP | 2005-277897 | 10/2005 |
| JP | 2007-014021 | 1/2007 |
| JP | 2007-159064 | 6/2007 |
| JP | 2008-187631 | 8/2008 |

OTHER PUBLICATIONS

International Search Report of PCT/JP2010/057785.

* cited by examiner

*Primary Examiner* — Huedung Mancuso
(74) *Attorney, Agent, or Firm* — Witham Curtis Christofferson & Cook, PC

(57) ABSTRACT

There is provided an antenna that enables easy soldering of an external conductor of a coaxial cable to a ground pattern.

An antenna device 10 capable of transmitting and receiving a radio wave includes a coaxial cable 20 having a center conductor 22 and an external conductor 21 and an antenna element 30. The antenna element 30 has an antenna pattern 32 and a ground pattern 34. The center conductor 22 is soldered to a first solder portion 324 of the antenna pattern 32, and the external conductor 21 is soldered to a second solder portion 344 of the ground pattern 34 by means of solder 52. The ground pattern 34 has an opening 34*a* defining the second solder portion 344. The second solder portion 344 is provided between the first solder portion 324 and the opening 34*a*.

14 Claims, 5 Drawing Sheets

ANTENNA DEVICE

TECHNICAL FIELD

The present invention is related to an antenna device and, more particularly, to an antenna device used at a frequency band of a wireless LAN (Local Area Network).

BACKGROUND ART

As is well known in this technical field, the wireless LAN designates a LAN utilizing a transmission channel other than a cable, like a radio wave and infrared radiation.

The IEEE (Institute of Electrical and Electronics Engineers) 802.11 Committee has standardized the wireless LAN. Specifically, the IEEE 802.11 Committee specifies and establishes standards for the wireless LAN.

For instance, IEEE 802.11a is a standard for a 5 GHz band high-speed wireless LAN/wireless access settled by the IEEE 802.11 Committee. Transmission speed (a transfer rate) is 20 to 50 Mbits/sec or thereabouts. CSMA/CD (carrier sense multiple access with collision detection) is adopted as MAC (medium access control). A modulation scheme for a physical layer is settled on OFDM (orthogonal frequency division multiplexing).

IEEE 802.11b includes specifications of the wireless LAN standardized by the IEEE 802.11 Committee in September 1999. A 2.4 GHz band frequency is employed in IEEE 802.11b, and direct spread (DS) is used for the modulation scheme. Transfer speed (a transfer rate) is classified into 11 Mbits/sec and 5.5 Mbits/sec.

Moreover, IEEE 802.11g is one of the specifications for a wireless LAN standardized by the IEEE 802.11 Committee in June 2003 and is designed to perform communication at about 54 bits/sec in a 2.4 GHz band. OFDM is adopted for the modulation scheme. Therefore, the IEEE 802.11g utilizes a frequency in 2.4 GHz band that is the same as that used for IEEE 802.11b and also supports a transfer rate of 54 Mbits/sec that is about five times as that supported by IEEE 802.11b. In contrast with IEEE 802.11a that supports a transfer rate of 54 Mbits/sec, IEEE 802.11g is also compatible with IEEE 802.11b. A maximum transfer rate of 54 Mbits/sec is completely identical with that provided by IEEE 802.11a. However, the 2.4 GHz band is used by a lot of other devices except the wireless LAN. Hence, the band has already become a "congested" frequency band often used by devices other than the wireless LAN. Therefore, an actual transfer rate achieved under IEEE 802.11g is said to become slower than the transfer rate achieved under IEEE 802.11a.

As mentioned above, IEEE 802.11b and IEEE 802.11g use the same frequency band; namely, 2.4 GHz band. Accordingly, both protocols are generically called IEEE 802.11b/g.

Various types of antenna devices used at such a frequency band for the wireless LAN have hitherto been known.

For instance, Patent Document 1 discloses a plane polarized antenna that is easy to be miniaturized and implemented. The plane polarized antenna described in connection with Patent Document 1 has a flat insulation substrate and a conductor part placed on the flat insulation substrate. The conductor part has an inverted-F antenna part having a feeding point and a ground plane part. A core wire (i.e., a center conductor) of a coaxial cable is connected to the feeding point of the inverted-F antenna part, and an earth line (an external conductor) of the coaxial cable is connected to the ground plane part.

Patent Document 2 describes a flat panel antenna that can assure stable communication and that exhibits superior space efficiency. The flat panel antenna described in connection with Patent Document 2 includes an element, a ground plate, and a short-circuit part that are placed on an insulative base material and is supplied with electric power by way of a strip line laid on the other side of the insulative base material. The strip line has a starting point and an end point. The starting point of the strip line forms one through hole formed in the insulative base material, and the end point of the strip line forms another through hole formed in the insulative base material. An internal conductor of a power feed coaxial cable is connected to the starting point of the strip line, and a feeding point of the element is connected to the end point of the strip line. An external conductor of the power feed coaxial cable is connected to an earth point of the ground plate.

In both antennas described in connection with Patent Document 1 and Patent Document 2, an antenna pattern is laid on a substrate; therefore, the antennas are called "substrate antennas."

In the meantime, Patent Document 3 describes a broadband, high-gain antenna. The antenna described in Patent Document 3 has an antenna element having at least one bend; a ground part to which one end of the antenna element is connected; a power feed part formed in the bend in a direction that divides an internal angle of the bend; and a power feed line connected to the power feed part. An internal conductor of a coaxial cable that is the power feed line is connected to the power feed part. An external conductor of the coaxial cable is connected to the ground part. When the antenna is manufactured, a flat plate made of phosphor bronze, for instance or the like, was pressed, thereby producing a conductor flat plate including an antenna element, a ground part, and a power feed part provided in a bend of the antenna element. The antenna using such a conductor flat plate is called a "sheet plate antenna."

Patent Document 4 describes a structure for connecting an antenna to a communication cable that can prevent occurrence of transmission and receiving frequency drifts, which would otherwise arise when the antenna and the communication cable are connected by means of soldering, or the like, thereby enhancing ease of connecting work. In Patent Document 4, the antenna is made up of an antenna element made of a metallic member and an insulation layer laid in at least a portion of a surface of the antenna element. Two window openings are made in the insulation layer. The antenna element and a conductor portion of the communication cable are connected to each other by way of the window openings. The antenna element is made up of a radiating conductor, a ground conductor, a short-circuit conductor, and a power feed path. The ground conductor has a rectangular shape. The communication cable has an internal conductor and an external conductor. The ground conductor and the external conductor are connected to each other by use of solder by way of the first window opening. The power feed path and the internal conductor are connected to each other by use of solder by way of the second window opening. The communication cable extends in a direction parallel to a longitudinal direction of the antenna element.

Patent Document 5 describes a compact, lightweight multi frequency antenna covering a wide tuning frequency range. The multi frequency antenna described in connection with Patent Document 5 includes an antenna element extending in a direction of an X axis; a ground plate conductively connected to the antenna element by way of a short-circuit line; and a coaxial cable that extends in parallel to a longitudinal direction of the antenna element and that is provided between the antenna element and the ground plate. A power feed line stretches from a feeding point of the antenna element. The ground plate has a projecting piece that projects toward the antenna element. A center conductor of the coaxial cable is connected to the power feed line, and an external conductor of the coaxial cable is connected to the projecting piece.

Patent Document 1: JP-A-2008-187631
Patent Document 2: JP-A-2005-136784
Patent Document 3: JP-A-2007-159064
Patent Document 4: JP-A-2004-173143
Patent Document 5: JP-A-2005-142739

SUMMARY OF INVENTION

Technical Problem

In the flat panel antenna, such as that mentioned above, an external conductor of a coaxial cable must be connected to a ground plate (a ground pattern) by means of soldering. Such soldering operation is performed as follows. Heat is applied to a specific location (a location to be soldered) on a ground plate (the ground pattern) by use of a soldering iron, thereby increasing a temperature of the specific location to a soldering temperature or more. Solder is thereby fused, to thus connect the external conductor of the coaxial cable to the ground plate (the ground pattern). Specifically, the location to be soldered (the specific location) must be heated to the soldering temperature or more.

The inventions described in Patent Documents 1 through 5 confront the following problems.

In the plane polarized antenna described in Patent Document 1, the ground plane part has a rectangular shape. Hence, heat of the soldering iron escapes from the specific location to surroundings of the ground plane part, to thus become dispersed. As a result, the temperature of the specific location cannot be increased to the soldering temperature or more, or increasing the temperature of the specific location to the soldering temperature or more involves consumption of much time. Specifically, there arises a problem of the difficulty of soldering.

Even in the flat panel antenna described in Patent Document 2, the ground plate has a rectangular shape. Hence, the heat of the soldering iron diffuses from an earth point (the specific location) to the surroundings of the ground plate. As a result, the temperature of the earth point (the specific location) cannot be increased to the soldering temperature or more, or increasing the temperature of the earth point to the soldering temperature or more involves consumption of much time. Specifically, there arises a problem of the difficulty of soldering.

Even in the antenna described in connection with Patent Document 3, since the ground part has a rectangular shape, the heat of the soldering iron diffuses from the specific location to surroundings of the ground part. As a result, a temperature of the specific location cannot be increased to the soldering temperature or more, or increasing the temperature of the specification location to the soldering temperature or more involves consumption of much time. In short, there is a problem of the difficulty of soldering.

In the antenna described in Patent Document 4, the ground conductor of the antenna element and the external conductor of the communication cable are connected to each other by way of the first window opening drilled in the insulation layer by use of a soldering iron. Such a structure encounters difficulty in transferring the solder of the soldering iron to the earth conductor. As a result, a problem of the difficulty of soldering arises.

In the multi frequency antenna described in Patent Document 5, the external conductor of the coaxial cable is connected to the projecting piece of the ground plate. Since the projecting piece is very small, there is a potential of the projecting piece peeling off from the ground plate. Thus, since peel strength is little, warpage may arise in an antenna pattern.

Therefore, a problem to be solved by the invention is to provide an antenna that enables easy soldering of an external conductor of a coaxial cable to a ground pattern.

Solution To Problem

The present invention provides an antenna device (10; 10A), for transmitting and receiving a radio wave, comprising: a coaxial cable (20) having a center conductor (22) and an external conductor (21); and an antenna element (30; 30A). The antenna element (30; 30A) has an antenna pattern (32; 32A and a ground pattern (34; 34A). The center conductor (22) of the coaxial cable (20) is electrically connected to a first solder portion (324; 324A) of the antenna pattern (32; 32A) by means of soldering of solder (51). The external conductor (21) of the coaxial cable (20) is electrically connected to a second solder portion (344; 344A) of the ground pattern (34; 34A) by means of soldering of solder (52). The ground pattern (34; 34A) has an opening (34*a*; 34Aa) defining the second solder portion (344; 344A), and the second solder portion (344; 344A) is provided between the first solder portion (324; 324A) and the opening (34*a*; 34Aa).

In the antenna device (10; 10A), the coaxial cable (20) extends on the ground pattern (32; 32A), in a direction (X) orthogonal to a direction (Y) in which the antenna pattern (32; 32A) extends, and in parallel to one side of the ground pattern (34; 34A). A predetermined frequency band is a frequency in a 2.4 GHz band. The antenna pattern (32; 32A) may also be an inverted-F antenna. In this case, the power feed part (324; 324A) of the inverted-F antenna serving as the first solder portion is connected to the center conductor (22) of the coaxial cable (20).

In the antenna device (10) of the first embodiment of the present invention, the antenna pattern (32) and the ground pattern (34) are formed of conductor foil formed on a principal surface (31*u*) of a substrate (31). The conductor foil is made of; for instance, copper foil.

In the antenna device (10A) of a second embodiment of the present invention, the antenna element (30A) is made up of a metallic plate. The metallic plate is preferably made of phosphor bronze.

In the antenna device (10; 10A), the ground pattern opening (34*a*; 34Aa) preferably has a rectangular shape elongated in the direction (Y) orthogonal to an axial direction (X) of the coaxial cable (20). A width (B) of the second solder portion (344; 344A) is preferably equal to a length of an exposed portion of the external conductor (21). A width (A) of the ground pattern opening (34*a*; 34Aa) is smaller than the width (B) of the second solder portion (344; 344A) and preferably is more than or equal to 0.2 mm. A length of the ground pattern opening (34*a*; 34Aa) preferably ranges from 3.4 mm to 5.4 mm.

The parenthesized reference numerals are provided in order to facilitate comprehension of the present invention and are merely illustrative. As a matter of course, the present invention is not limited to the examples.

Advantageous Effects of Invention

In the antenna of the present invention, an opening defining the second solder portion is formed in the ground pattern. Hence, escape of heat from the second solder portion during soldering can be hindered. As a result, the external conductor of the coaxial cable can readily be soldered to the ground pattern.

BRIEF DESCRIPTION OF DRAWINGS

FIGS. 3B and 3C are enlarged plan and side views of the soldered principal part.

DESCRIPTION OF EMBODIMENTS

Embodiments of the present invention are hereunder described in detail by reference to the drawings.

Figure 1:
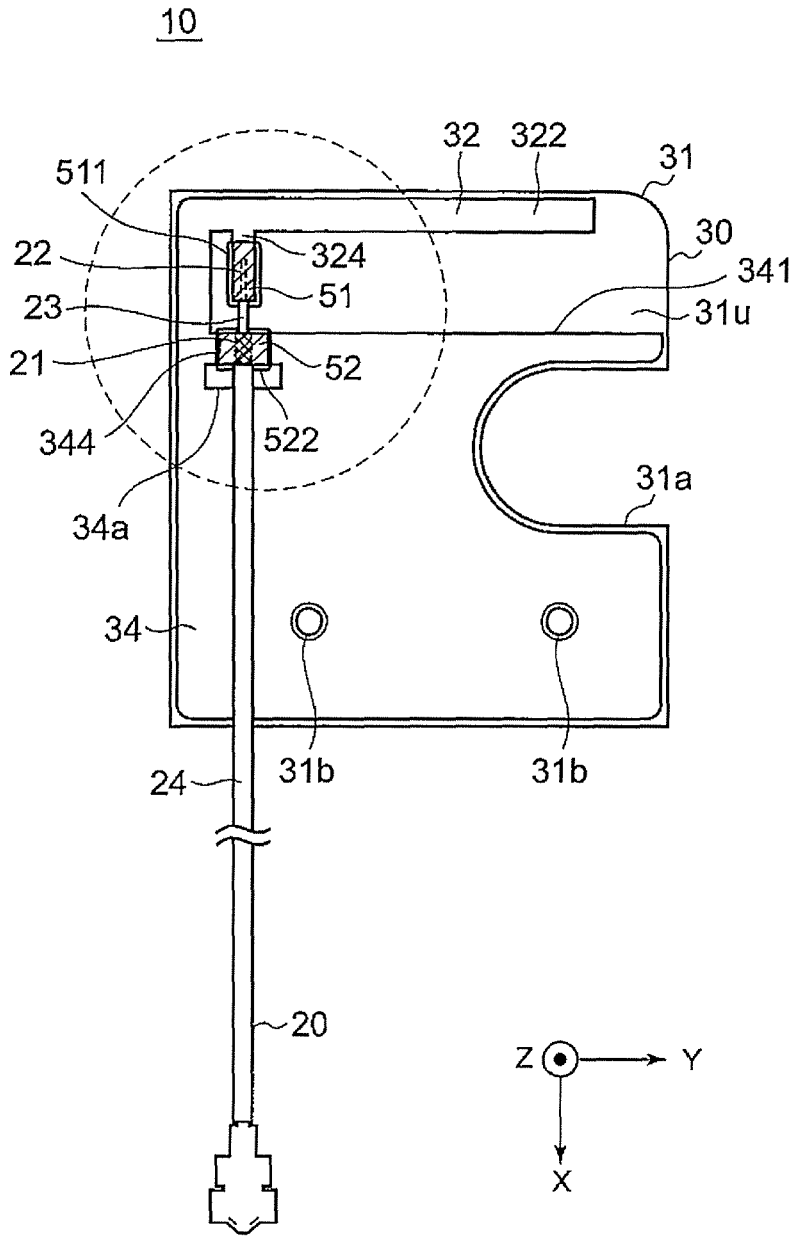
FIG. 1 is a plan view of an antenna device of a first embodiment of the present invention.
Figure 2:
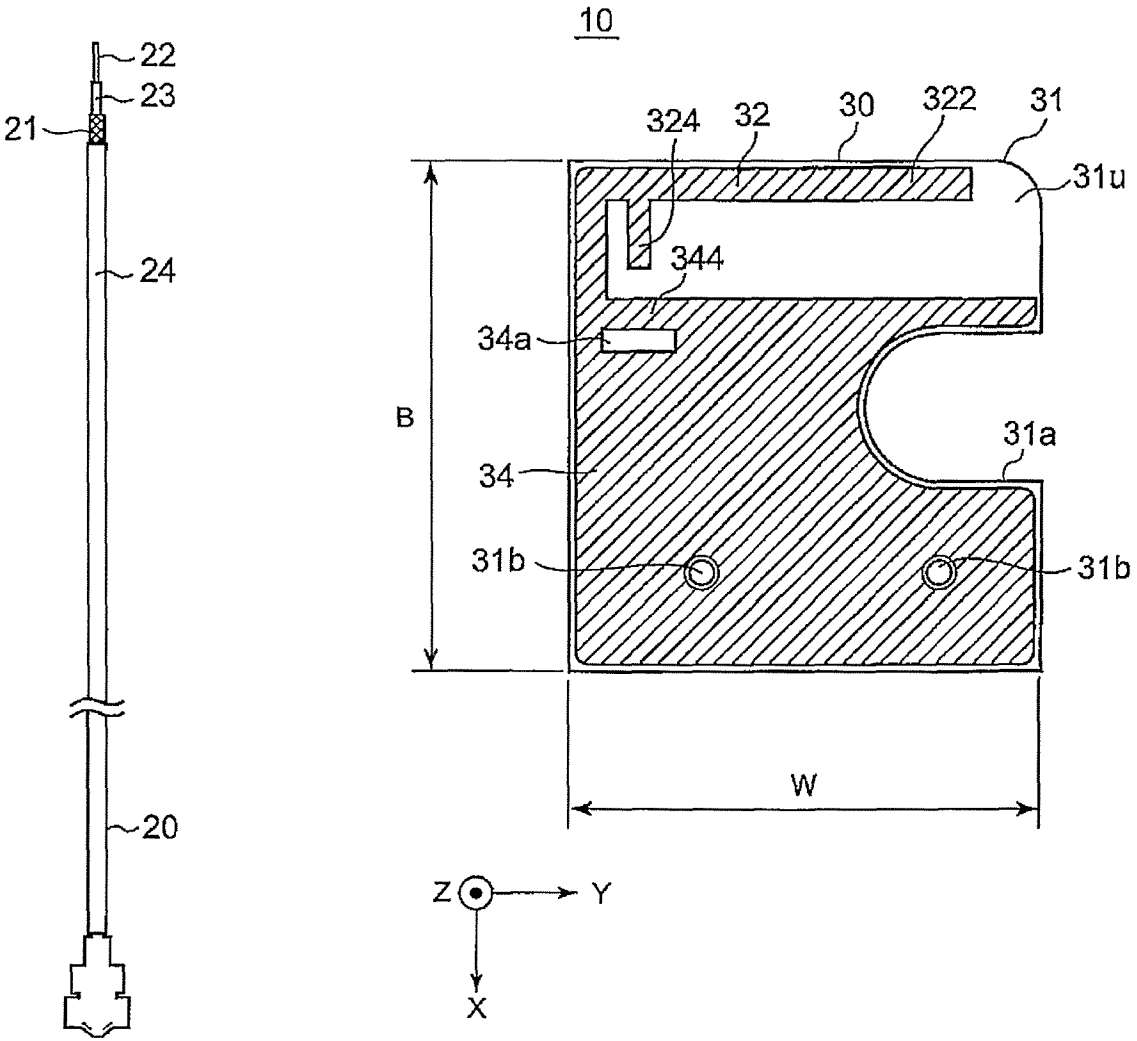
FIG. 2 is an exploded plan view of the antenna device shown in FIG. 1.

By reference to FIGS. 1 and 2, an antenna device (a substrate antenna) 10 of a first embodiment of the present invention is described.

In FIGS. 1 and 2, a Cartesian coordinate system (X, Y, Z) is adopted. In a state shown in FIGS. 1 and 2, a direction of an X axis corresponds to a front-back direction (a depthwise direction). A direction of a Y axis corresponds to a right-left direction (a widthwise or horizontal direction). A direction of a Z axis corresponds to a vertical direction (a height direction).

The illustrated antenna device 10 is for transmitting and receiving a radio wave in a predetermined frequency band. In an illustrated example, a predetermined frequency band is a frequency in a 2.4 GHz band employed by IEEE 802.11b/g.

The illustrated antenna device 10 has a coaxial cable 20 and an antenna element 30.

As shown in FIG. 2, the coaxial cable 20 has a cylindrical external conductor 21 and a center conductor 22 placed in the center of the external conductor 21. Thus, the coaxial cable 20 works as a coaxial electric signal transmission medium. The external conductor 21 and the center conductor 22 are insulated from each other by means of a cylindrical insulator 23. The external conductor 21 is covered with a sheath 24. The external conductor 21 is also called an earth line or an external conductor and made up of a meshed conducting wire as shown in FIG. 2. The center conductor 22 is also called a core wire or an internal conductor.

In an illustrated example, the coaxial cable 20 has a diameter of 0.8 mm. Further, the external conductor 22 has an outer diameter of 0.6 mm.

As shown in FIG. 1, the coaxial cable 20 extends in the front-back direction (the direction of the X axis). A leading end of the coaxial cable 20 is cut as shown in FIG. 2, and the center conductor 22, the insulator 23, and the external conductor 21 are exposed from the leading end.

The antenna element 30 has a flat-plate-like printed wiring board 31 having a principal surface (a front surface or an upper surface) 31*u*. The printed wiring board 31 has a rectangular shape having a length (a longitudinal length) B and a width (a lateral length) W. In the illustrated example, the length (longitudinal length) B is 24.7 mm, and the width (the lateral length) W is 22.8 mm. In the illustrated example, the printed wiring board 31 has an opening 31*a* at the center of a right surface. A pair of mount holes 31*b* used for mounting the antenna device 10 to an enclosure (not shown) are formed in the printed wiring board 31.

The antenna element 30 has an antenna pattern 32 and a ground pattern 34 formed over the principal surface 31*u* of the printed wiring board 31. The antenna element 30 (the antenna pattern 32 and the ground pattern 34) is covered with a resist film (not shown) formed over the principal surface 31*u* of the printed wiring board 31. The ground pattern 34 is formed integrally with the antenna pattern 32. The antenna pattern 32 and the ground pattern 34 are made of copper foil. In the illustrated embodiment, the antenna pattern 32 is made up of an inverted-F antenna. The inverted-F antenna 32 has an L-shaped L part 322 and a power feed part 324 extending from the L part 322. The L part 322 has a long side extending in the lateral direction (the direction of the Y axis) and a short side extending in the front-back direction (the direction of the X axis).

In the illustrated embodiment, the antenna pattern 32 and the ground pattern 34 are made of copper foil. However, they can also be made of another conductor foil.

As shown in FIG. 1, the coaxial cable 20 is laid on the ground pattern 34 and extends in a direction orthogonal (in the front-back direction X) to the longitudinal direction (the left-right direction Y) of the antenna pattern 32 and in parallel to one side (the left side) of the ground pattern 34.

The center conductor 22 of the coaxial cable 20 is electrically connected to the power feed part 324 of the antenna pattern 32 exposed through a first deleted portion 511 of the resist film by means of soldering of the solder 51. Specifically, the power feed part 324 acts as a first solder portion.

In the meantime, the external conductor 21 of the coaxial cable 20 is electrically connected by way of a second solder portion 344 of the ground pattern 34 exposed from a second deleted portion 522 of the resist film and by means of soldering 52.

In the first embodiment of the present invention, the ground pattern 34 has a rectangular ground pattern opening 34*a* that defines a location of the second solder portion 344, in a vicinity of the second solder portion 344.

Figure 3A:
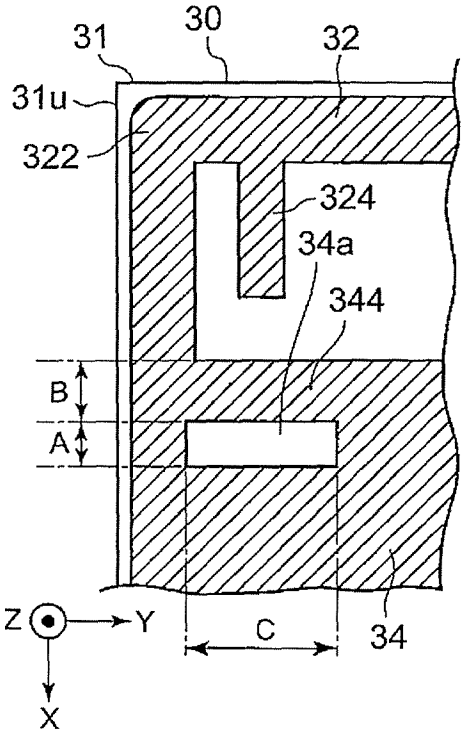
FIGS. 3A to 3C are enlarged views of a portion of the antenna device surrounded by a broken circle shown in FIG. 1, wherein FIG. 3A denotes an enlarged plan view of a yet-to-be-soldered principal part of the antenna device.
Figure 3B:
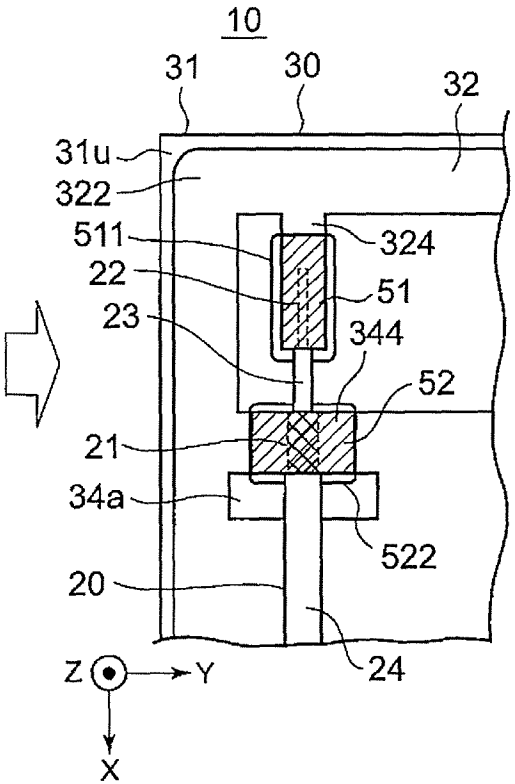
Figure 3C:
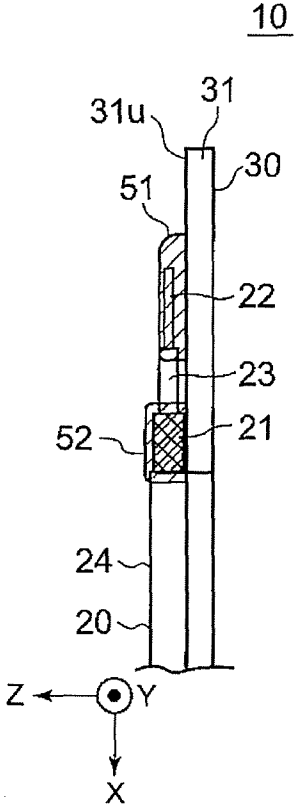

FIGS. 3A to 3C are enlarged views of a portion of the antenna device 10 surrounded by the broken circle shown in FIG. 1. FIG. 3A is an enlarged plan view of a yet-to-be-soldered principal part, and FIGS. 3B and 3C are enlarged plan and cross sectional views of the soldered principal part showing states of the soldered principal part.

The ground pattern opening 34*a* is intended for preventing heat of a soldering iron (not shown) from escaping from the second solder portion 344 when the external conductor 21 of the coaxial cable 20 is soldered to the second solder portion 344 of the ground pattern 34 by means of solder 52. The temperature of the second solder portion 344 can thereby be increased to a soldering temperature or more in a short time. As a result, the external conductor 21 of the coaxial cable 20 can easily be soldered to the ground pattern 34.

The present inventors ascertained that presence/absence of the ground pattern opening 34*a* did not exert influence on electrical performance of the antenna device 10.

A position of the second solder portion 344 is defined as follows.

The second solder portion 344 is situated between the ground pattern opening 34*a* and an upper end side 341 of the ground pattern 34; namely, a range defined by the width B in FIG. 3A and also defined by the width C in FIG. 3A. The power feed part 324 and the ground pattern opening 34*a* are placed opposite each other by way of the second solder portion 344. Put another way, the second solder portion 344 is sandwiched between the power feed part (the first solder portion) 324 and the ground pattern opening 34*a*.

In the illustrated embodiment, the length C of the ground pattern opening 34*a* in its left-right direction Y is 3.4 mm, and the width A of the ground pattern opening 34*a* in its front-back direction X is 1 mm.

The width B of the second solder portion 344 is substantially identical with the length of the exposed external conductor 21 of the coaxial cable 20. In the illustrated embodiment, the width B is 1.5 mm. The minimum requirement for the width B is to be sufficient to assure strength for soldering the solder 52.

In the meantime, the minimum requirement for the width A of the ground pattern opening 34*a* is to be sufficient to insulate heat during soldering of the solder 52. Moreover, from the viewpoint of enhancement of an antenna characteristic, it is desirable that the dimension A should be minimum. Therefore, the dimension A is preferably defined as 0.2 mm≤A<B.

In relation to the length C of the ground pattern opening 34*a*, the time required to solder the solder 52 can be further shortened as the length C is made longer in the right direction. The reason for this is that an escape of heat from the second solder portion 344 can be inhibited. Conversely, if the length C is made excessively longer, an electric characteristic of the antenna will be adversely affected. Therefore, a preferred range of the length C is 3.4 mm≤C≤5.4 mm.

Figure 4:
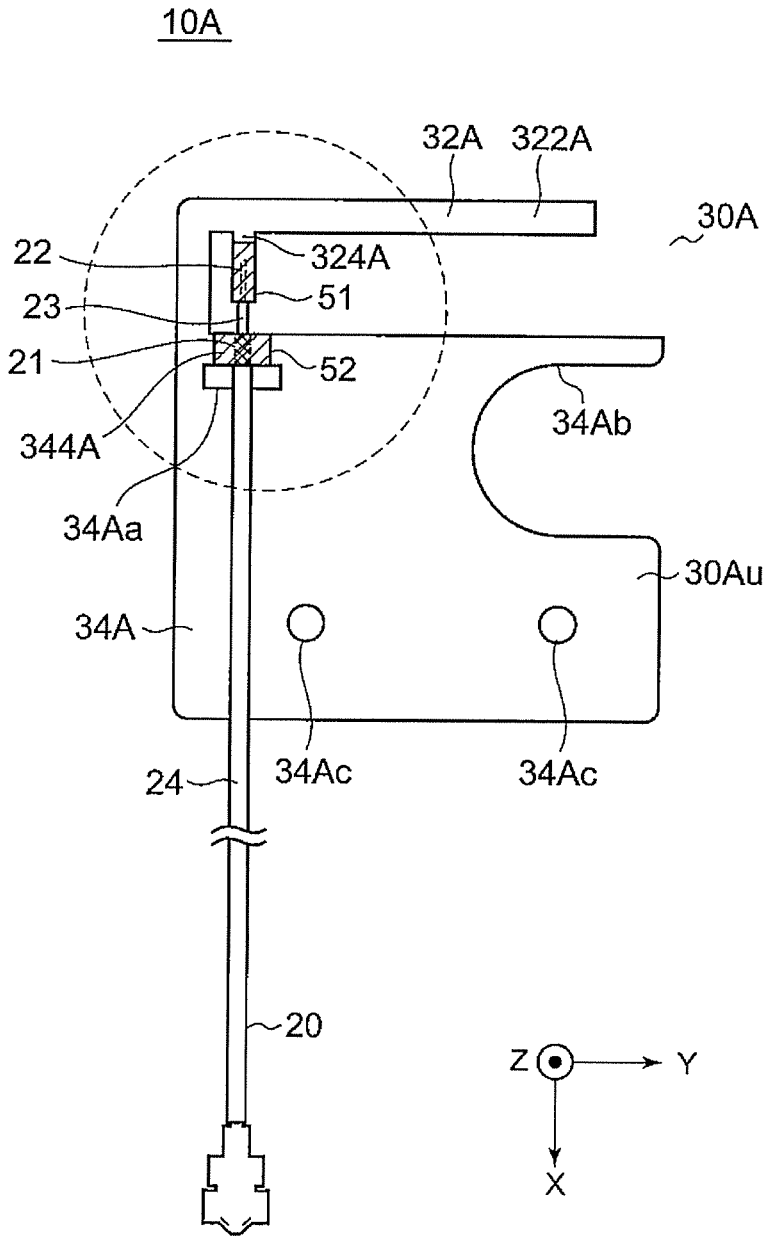
FIG. 4 is a plan view of an antenna device of a second embodiment of the present invention.
Figure 5:
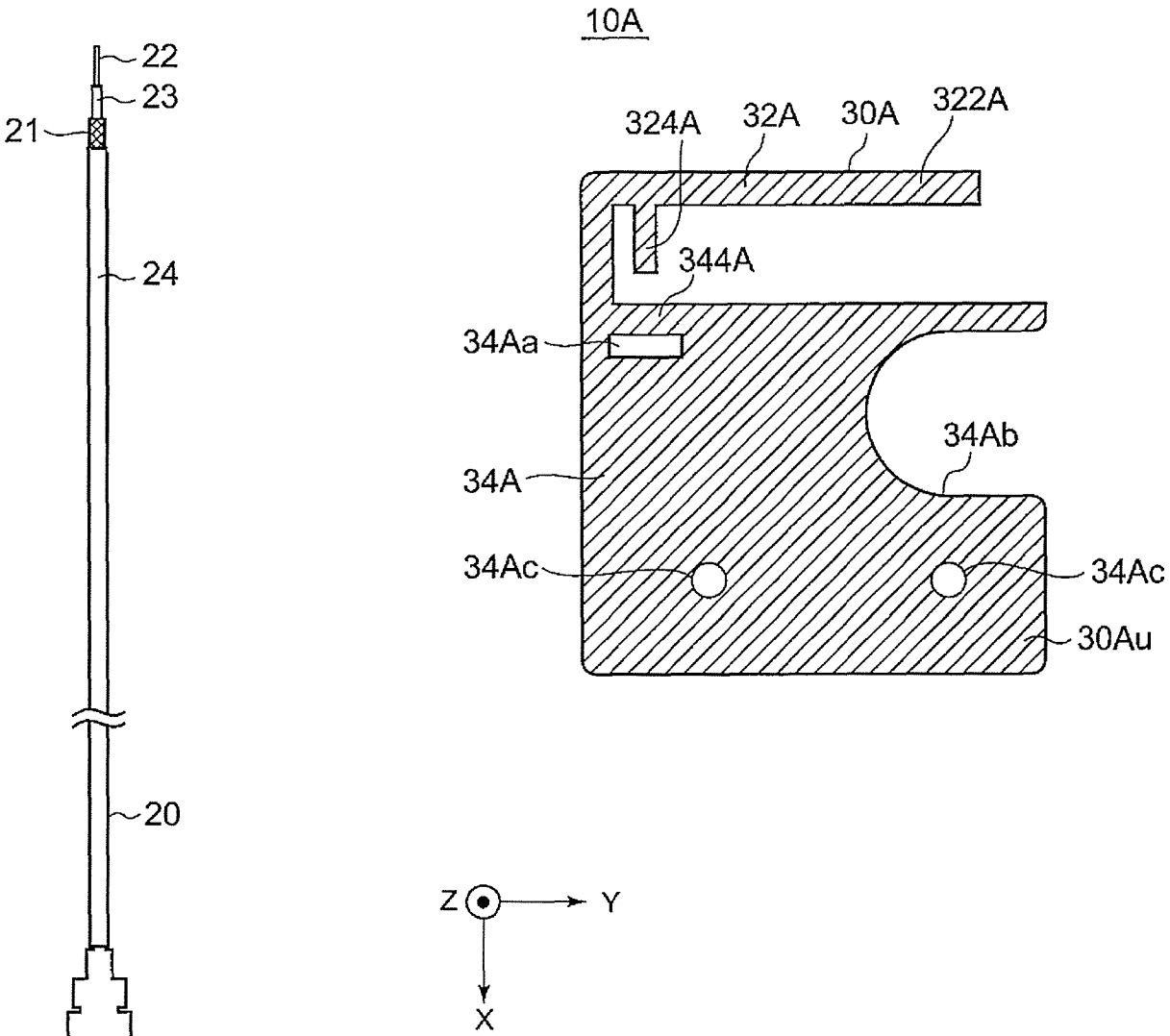
FIG. 5 is an exploded plan view of the antenna device shown in FIG. 4.

By reference to FIGS. 4 and 5, an antenna device 10A of a second embodiment of the present invention is now described.

FIGS. 4 and 5 adopt the Cartesian coordinate system (X, Y, Z). In a state shown in FIGS. 4 and 5, the direction of the X axis corresponds to a front-back direction (a depthwise direction), and the direction of the Y axis corresponds a left-right direction (a widthwise direction or a horizontal direction). The direction of a Z axis corresponds to a vertical direction (a height direction).

The illustrated antenna device 10A has the same configuration as that of the antenna device 10 shown in FIGS. 1 and 2 except that an antenna element differs from that shown in FIGS. 1 and 2. Accordingly, reference numeral 30A is appended to the antenna element. Constituent elements having the same functions as those of the constituent elements shown in FIGS. 1 and 2 are given the same reference numerals. Detailed explanations are given solely to the differences for simplification of explanation.

The illustrated antenna device WA is for transmitting and receiving a radio wave in a predetermined frequency band. In the illustrated embodiment, the predetermined frequency band is a frequency in the 2.4 GHz band used for IEEE 802.11b/g.

The antenna element 30A is made by pressing a flat-plate-like metallic plate having a principal surface (a front surface or an upper surface) 30Au. In the illustrated embodiment, the metallic plate is formed from phosphor bronze that is not plated.

In the illustrated embodiment, phosphor bronze is used as a material of the metallic plate. However, a material for the metallic plate is not limited to phosphor bronze.

The antenna element 30A has an antenna pattern 32A and a ground pattern 34A formed integrally with the antenna pattern 32A. In the illustrated embodiment, the antenna pattern 32A is formed from an inverted-F antenna. The inverted-F antenna 32A has an L-shaped L part 322A and a power feed part 324A projecting out of the L part 322A. The L part 322A has long sides extending in the horizontal direction (along the direction of the Y axis) and short sides extending in the front-back direction (the direction of the X axis). Although the ground pattern 34A substantially has a rectangular shape, an opening 34Ab is formed in an upper right portion of the ground pattern 34A. A pair of mount holes 34Ac used for mounting the antenna device 10A to an enclosure (not shown) are drilled in the ground pattern 34A.

As shown in FIG. 4, the coaxial cable 20 extends over the ground pattern 34A along a direction (the front-back direction X) orthogonal to the longitudinal direction (the left-right direction Y) of the antenna pattern 32A and in parallel to one side (the left side) of the ground pattern 34A.

The center conductor 22 of the coaxial cable 20 is electrically connected to the power feed part 324A of the antenna pattern 32A by means of soldering the solder 51. Specifically, the power feed part 324A acts as a first solder portion.

In the meantime, the external conductor 21 of the coaxial cable 20 is electrically connected to a second solder portion 344A of the ground pattern 34A by means of soldering the solder 52.

In the second embodiment of the present invention, the ground pattern 34A has, in a neighborhood of the second solder portion 344A, a rectangular ground pattern opening 34Aa that defines the second solder portion 344A. The second solder portion 344A is sandwiched between the power feed portion (the first solder portion) 324A and the ground pattern opening 34Aa.

The ground pattern opening 34Aa is for preventing the heat of the soldering iron (not shown) from escaping by way of the second solder portion 344A when the external conductor 21 of the coaxial cable 20 is soldered to the second solder portion 344A of the ground pattern 34A by means of the solder 52. It is thereby possible to increase the temperature of the second solder portion 344A to the soldering temperature or more within a short period of time. As a consequence, the external conductor 21 of the coaxial cable 20 can readily be soldered to the ground pattern 34A.

The present inventors ascertained that presence/absence of the ground pattern opening 34Aa did not exert influence on electrical performance of the antenna device 10A.

The second solder portion 344A has a width similar to that of the second solder portion 344 described by reference to FIG. 3A. Further, the length and width of the ground pattern opening 34Aa are the same as the length and width of the ground pattern opening 34*a* described by reference to FIG. 3A.

Although the preferred embodiments of the present invention have been described thus far, it is natural that the present invention should not be limited to the embodiments. For instance, the antenna pattern is not limited to the inverted-F antenna described in connection with the embodiments, and antenna patterns of various shapes can naturally be adopted. In the embodiments, the ground pattern openings ha a rectangular shape. However, the ground pattern openings are not limited to a rectangular shape and can also ha an arbitrary shape.

Although the present invention has been described in detail by reference to the specific embodiments, it is manifest to those skilled in the art that the present invention be susceptible to various alterations or modifications without departing the spirit and scope or purport of the invention.

The present invention is based on Japanese Patent Application (JP-2009-163889) filed on Jul. 10, 2009, the entire subject matter of which is incorporated herein by reference.

INDUSTRIAL APPLICABILITY

An antenna that enables easy soldiering of an external conductor of a coaxial cable to a ground pattern can be provided.

REFERENCE SIGNS LIST

10 ANTENNA (SUBSTRATE ANTENNA)
10A ANTENNA (PLATE METAL ANTENNA)
20 COAXIAL CABLE (FEED LINE)
21 EXTERNAL CONDUCTOR
22 CENTER CONDUCTOR
23 INSULATOR
24 SHEATH (CASING)
30, 30A ANTENNA ELEMENT
30Au PRINCIPAL SURFACE (UPPER SURFACE, FRONT SURFACE)
31 PRINTED WIRING BOARD
31*u* PRINCIPAL SURFACE (UPPER SURFACE, FRONT SURFACE)
32, 32A ANTENNA PATTERN
322, 322A L PART
324, 324A POWER FEED PART (FIRST SOLDER PORTION)
34, 34A GROUND PATTERN
341 UPPER END SIDE
344, 344A SECOND SOLDER PORTION
34*a*, 34Aa GROUND PATTERN OPENING
51, 52 SOLDER
511, 522 DELETED PORTION OF RESIST FILM
A WIDTH OF GROUND PATTERN OPENING
B WIDTH OF SECOND SOLDER PORTION
C LENGTH OF GROUND PATTERN OPENING

The invention claimed is:

1. An antenna device, for transmitting and receiving a radio wave, comprising:

a coaxial cable having a center conductor and an external conductor; and an antenna element having an antenna pattern and a ground pattern, wherein the center conductor is electrically connected to a first solder portion of the antenna pattern by soldering, the external conductor is electrically connected to a second solder portion of the ground pattern by soldering, and the ground pattern has an opening defining the second solder portion so as to prevent heat from escaping from the second solder portion, and the second solder portion is provided between the first solder portion and the opening.

2. The antenna device according to claim 1, wherein the coaxial cable extends on the ground pattern, in a direction orthogonal to a direction in which the antenna pattern extends, and in parallel to one side of the ground pattern.

3. The antenna device according to claim 1, wherein a frequency band of the radio wave is a frequency in a 2.4 GHz band.

4. The antenna device according to claim 1, wherein the antenna pattern is an inverted-F antenna, and a power feed part of the inverted-F antenna includes the first solder portion.

5. The antenna device according to claim 1, wherein the antenna pattern and the ground pattern are laid on a principal surface of a substrate.

6. The antenna device according to claim 5, wherein the antenna pattern and the ground pattern are formed of conductor foil laid on the principal surface of the substrate.

7. The antenna device according to claim 6, wherein the conductor foil is made of copper foil.

8. The antenna device according to claim 1, wherein the antenna element is made of a metallic plate.

9. The antenna device according to claim 8, wherein the metallic plate is made of phosphor bronze.

10. The antenna device according to claim 1, wherein the opening has a rectangular shape extending in a direction orthogonal to an axial direction of the coaxial cable.

11. The antenna device according to claim 10, wherein a width of the second solder portion is equal to a length of an exposed portion of the external conductor.

12. The antenna device according to claim 11, wherein a width of the opening is smaller than the width of the second solder portion and is more than or equal to 0.2 mm.

13. The antenna device according claim 10, wherein a length of the opening of the ground pattern ranges from 3.4 mm to 5.4 mm.

14. An antenna element comprising:

an antenna pattern having a first solder portion; and a ground pattern having a second solder portion, wherein the ground pattern has an opening defining the second solder portion so as to prevent heat from escaping from the second portion, and the second solder portion is provided between the first solder portion and the opening.

* * * * *